US012269665B2

(12) United States Patent
Costanzo, Jr.

(10) Patent No.: US 12,269,665 B2
(45) **Date of Patent: *Apr. 8, 2025**

(54) COOLER APPARATUS AND METHOD OF MAKING FROM FOLDING SINGLE SHEET OF CORRUGATED MATERIAL

(71) Applicant: BRRR BOX, LLC, Fort Mill, SC (US)

(72) Inventor: Donn J. Costanzo, Jr., Fort Mill, SC (US)

(73) Assignee: BRRR BOX, LLC, Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/412,227

(22) Filed: Jan. 12, 2024

(65) Prior Publication Data

US 2024/0228148 A1 Jul. 11, 2024

Related U.S. Application Data

(63) Continuation of application No. 18/118,047, filed on Mar. 6, 2023, now Pat. No. 11,919,700, which is a (Continued)

(51) Int. Cl.
*B65D 81/38* (2006.01)
*B65D 5/20* (2006.01)
(Continued)

(52) U.S. Cl.
CPC ..... *B65D 81/386* (2013.01); *B65D 5/2076* (2013.01); *B65D 5/4266* (2013.01); *B65D 5/46024* (2013.01)

(58) Field of Classification Search
CPC ..... F25D 3/06; F25D 3/08; B31B 1/26; B31B 1/76; B65D 81/38; B65D 5/3678; B65D 5/563; B65D 5/46112; B65D 5/4608; B65D 5/241
USPC ..... 229/117.14, 186, 117.06, 138, 920, 114, 229/117.01, 190; 206/163, 169, 427; 493/311; 62/457.5, 371, 457.1, 457.7, 62/464
See application file for complete search history.

(56) References Cited

U.S. PATENT DOCUMENTS 2,007,810 A * 7/1935 Oman ..... B65D 5/46112 229/117.22
5,018,663 A * 5/1991 Corso ..... B65D 5/22 229/148
(Continued)

*Primary Examiner* — Christopher R Demeree
(74) *Attorney, Agent, or Firm* — TILLMAN WRIGHT, PLLC; Chad D. Tillman

(57) ABSTRACT

A box is made by folding a sheet of material. Preferably, the box is formed by applying adhesive and folding using a machine, and a waterproof or water resistant coating is applied so that the box is configured for use as a cooler. The box includes (a) a storage portion, including a bottom panel, a first end panel, a second end panel, a first side panel, and a second side panel; (b) four corner panels; (c) a top panel including tabs; and (d) a latching panel attached to the first side panel and pivotable relative thereto about a fold line, the latching panel including first and second subpanels. The latching panel includes cuts extending between and dividing the first and second subpanels through which the tabs respectively extend when the cooler is in a closed position.

11 Claims, 12 Drawing Sheets

Related U.S. Application Data continuation of application No. 17/496,761, filed on Oct. 7, 2021, now Pat. No. 11,597,581, which is a continuation of application No. 16/675,125, filed on Nov. 5, 2019, now Pat. No. 11,214,428.

(60) Provisional application No. 62/755,558, filed on Nov. 5, 2018.

(51) Int. Cl.
*B65D 5/42* (2006.01)
*B65D 5/46* (2006.01)

(56) References Cited

U.S. PATENT DOCUMENTS 5,042,715 A * 8/1991 McNeill ..... B65D 5/26
229/117.15
6,182,465 B1 * 2/2001 Ricci ..... B65D 81/3848
62/457.1
6,736,309 B1 * 5/2004 Westerman ..... B65D 5/46144
229/148
7,673,787 B2 * 3/2010 Mittelstaedt ..... B65D 5/665
229/117.17

* cited by examiner

A water-resistant or waterproof coating is applied to blank for use as cooler

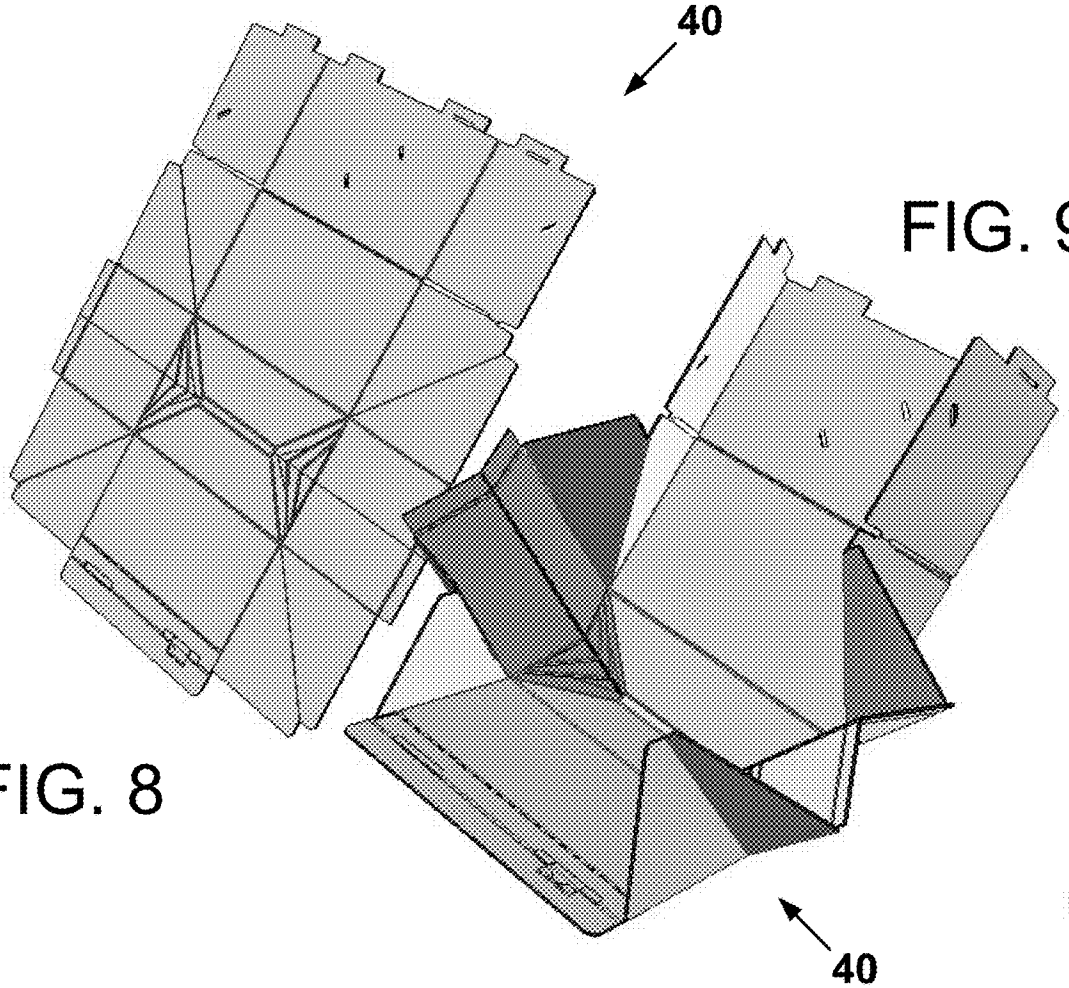
FIG. 8
FIG. 9
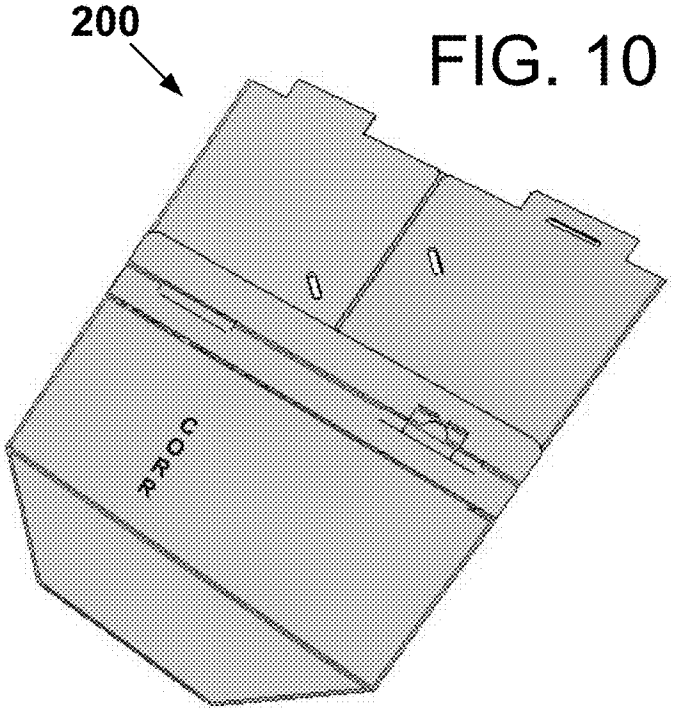
FIG. 10

COOLER APPARATUS AND METHOD OF MAKING FROM FOLDING SINGLE SHEET OF CORRUGATED MATERIAL

The present application hereby incorporates by reference U.S. patent application 62/755,558, filed Nov. 5, 2018, including the disclosure thereof in its entirety comprising the code of the appendix thereof.

COPYRIGHT STATEMENT

Any new and original work of authorship in this document—including any source code—is subject to copyright protection under the copyright laws of the United States and other countries. Reproduction by anyone of this document as it appears in official governmental records is permitted, but otherwise all other copyright rights whatsoever are reserved.

Computer Program Listing

Submitted concurrently herewith via the USPTO's electronic filing system, and incorporated herein by reference, are computer program files including instructions, routines, and/or other contents of several computer programs. A table setting forth the name and size of files included in the computer program listing is included below.

| File Name | Creation Date | File Size (bytes) |
|---|---|---|
| ascify.txt | Oct. 10, 2023 11:35 | 37473 |
| readme.txt | Oct. 10, 2023 08:00 | 2596 |
| movie.txt | Oct. 10, 2023 11:34 | 6767573 |

One of these files, "readme.txt", contains instructions for extracting information from other of the files. These other files represent a compressed binary file that has been converted to ascii format. The "movie.txt" file can be converted back to a compressed .zip archive utilizing an assembly conversion program source code for which is contained in "ascify.txt". The readme file includes instructions for compiling and running this conversion program, and instructions for converting the other text files to a compressed, binary file. This compressed, binary file includes a .mov video illustrating aspects and features in accordance with one or more preferred embodiments.

BACKGROUND OF THE INVENTION

The present invention is believed to represent one or more improvements over coolers disclosed in U.S. Patent Application Publication 2012/0234715, which is incorporated herein by reference in its entirety. One or more of the improvements are at least in regard to the ability to securely close the cooler when in the use configuration, and one or more of the improvements are at least in regard to enhanced structural strength of the cooler during manual lifting using a top handle.

SUMMARY OF THE INVENTION

The present invention relates to a box and, more specifically, a box used as a cooler for containing ice for keeping items cool, including for example beverages or food. In preferred embodiments, the cooler is made from a corrugated material and, preferably, a single sheet of corrugated material such as cardboard that is folded into an assembled cooler configuration. The cooler when in the assembled cooler configuration preferably is transitionable between a collapsed configuration for storage, shipping, disposal or recycling after use, and/or retail sale; and an expanded configuration for use in keeping items cool.

In an aspect of the invention, a box is made by folding a sheet of material. Preferably, the box is formed by applying adhesive and folding using a machine. The box comprises: (a) a storage portion, including a bottom panel, a first end panel, a second end panel, a first side panel, and a second side panel; (b) four corner panels; (c) a top panel including tabs; and (d) a latching panel attached to the first side panel and pivotable relative thereto about a fold line, the latching panel comprising first and second subpanels. The latching panel includes cuts extending between and dividing the first and second subpanels through which the tabs extend when the cooler is in a closed position.

In a feature, a line of perforations extends between and divides the latching panel and the first side panel.

In a feature, the box further includes a latch for securing together the latching panel and the lid when the cooler is in the closed position, one of the tabs including a slot through which a portion of the latch is configured to extend. A second latch also may be included for securing together the latching panel and the lid when the cooler is in the closed position, another one of the tabs including a slot through which a portion of the second latch is configured to extend.

In a feature, the box further includes first and second reinforcing handle attachment panels. Preferably, a fold line extends between and divides the first reinforcing handle attachment panel and the top panel, and no fold line extends between and divides the first reinforcing handle attachment panel and any of the four corner panels, the first reinforcing handle attachment panel being separated from each of the four corner panels. Additionally, a fold line extends between and divides the second reinforcing handle attachment panel and the top panel, and wherein no fold line extends between and divides the second reinforcing handle attachment panel and any of the four corner panels, the second reinforcing handle attachment panel being separated from each of the four corner panels.

In another feature, a waterproof or water resistant coating is applied to the sheet of material of the box for use of the box as a cooler.

In another feature, the box is in an assembled, collapsed configuration.

Another aspect relates to a method of folding a box from a single sheet of material, and another aspect relates to a method of making such a blank.

Additional aspects and features of the invention are disclosed in the drawings.

Still additional aspects and features of the invention are disclosed in the video of the computer program listing, which is incorporated herein by reference and which shows operation and use of a preferred cooler of the present invention.

In addition to the aforementioned aspects and features of the present invention, it should be noted that the present invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the present invention now will be described in detail with reference to the accompanying drawings, wherein the same elements are referred to with the same reference numerals.

FIGS. 8, 9, and 10 illustrate additional perspective views corresponding, respectively, to FIGS. 5, 6, and 7 showing the folding of the blank into the assembled, collapsed cooler configuration.

DETAILED DESCRIPTION

Figure 1:
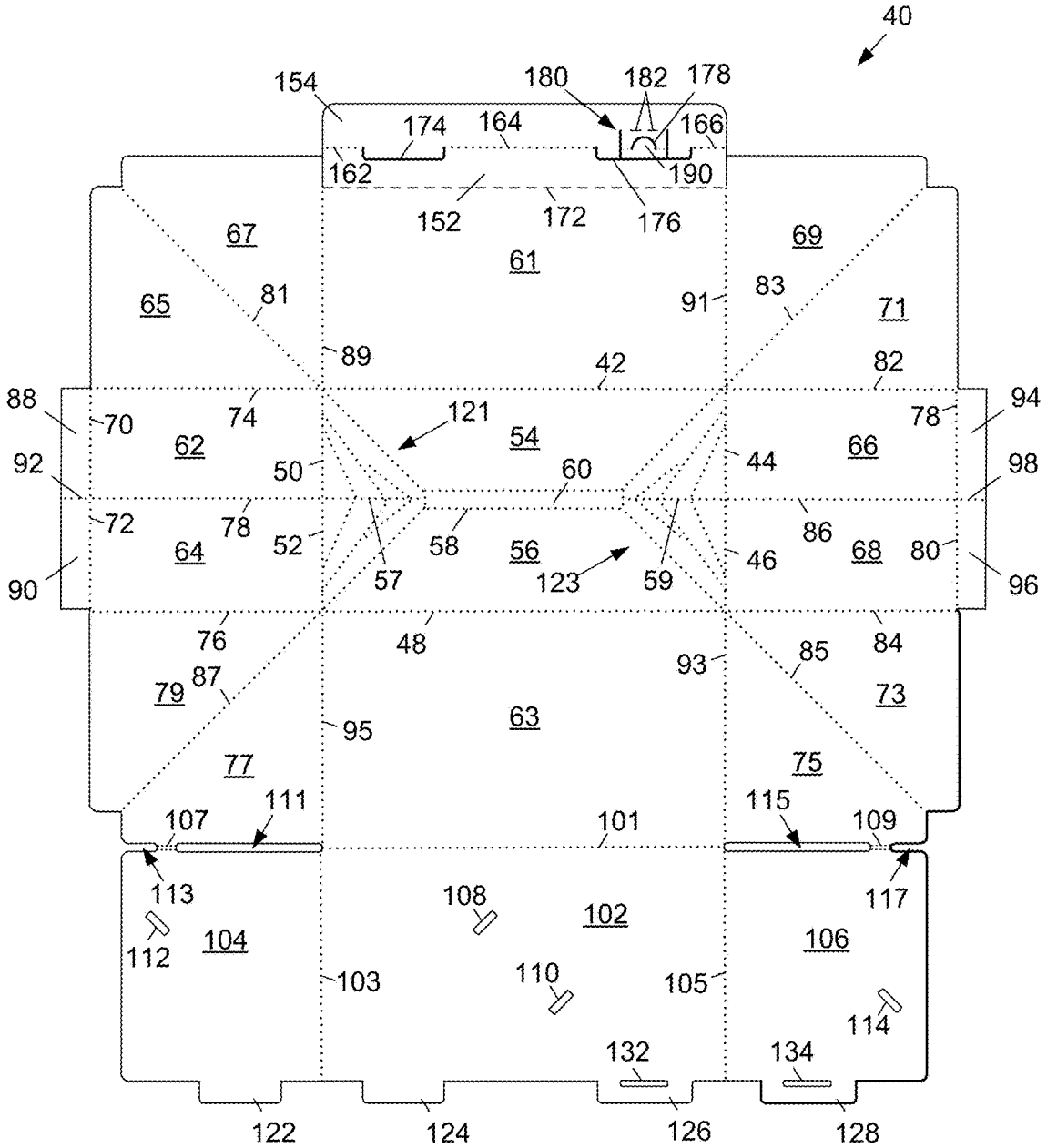
FIG. 1 is a plan view of a first side of a blank 40 for forming a preferred cooler in accordance with one or more aspects and features of the invention.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "comprising" is open-ended insofar as that which follows such term is not exclusive. Additionally, "a" and "an" each generally denotes "at least one" but does not exclude a plurality unless the contextual use dictates otherwise. Thus, reference to "a picnic basket having an apple" is the same as "a picnic basket comprising an apple" and "a picnic basket including an apple", each of which identically describes "a picnic basket having at least one apple" as well as "a picnic basket having apples"; the picnic basket further may contain one or more other items beside an apple. In contrast, reference to "a picnic basket having a single apple" describes "a picnic basket having only one apple"; the picnic basket further may contain one or more other items beside an apple. In contrast, "a picnic basket consisting of an apple" has only a single item contained therein, i.e., one apple; the picnic basket contains no other item.

When used herein to join a list of items, "or" denotes "at least one of the items" but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers"; the picnic basket further may contain one or more other items beside cheese and crackers.

When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese"; the picnic basket further may contain one or more other items beside cheese and crackers.

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Additionally, as used herein, a "fold line" is intended to mean that along which something is folded and may comprise a "score line". A "score line" is intended to mean an elongated area along which a fold is predisposed to form upon application of force. Within this broader context, a score line may be a generally linear area of weakness formed in a corrugated or non-corrugated panel along which the panel is predisposed to fold upon application of a force on the panel. A score line may be formed by way of example, and not limitation, by notching, scratching, incision, compression, perforation, physical deformation, or otherwise.

Referring now to the drawings, one or more preferred embodiments of the invention are next described. The following description of one or more preferred embodiments is merely exemplary in nature and is in no way intended to limit the invention, its implementations, or uses.

Figure 2:
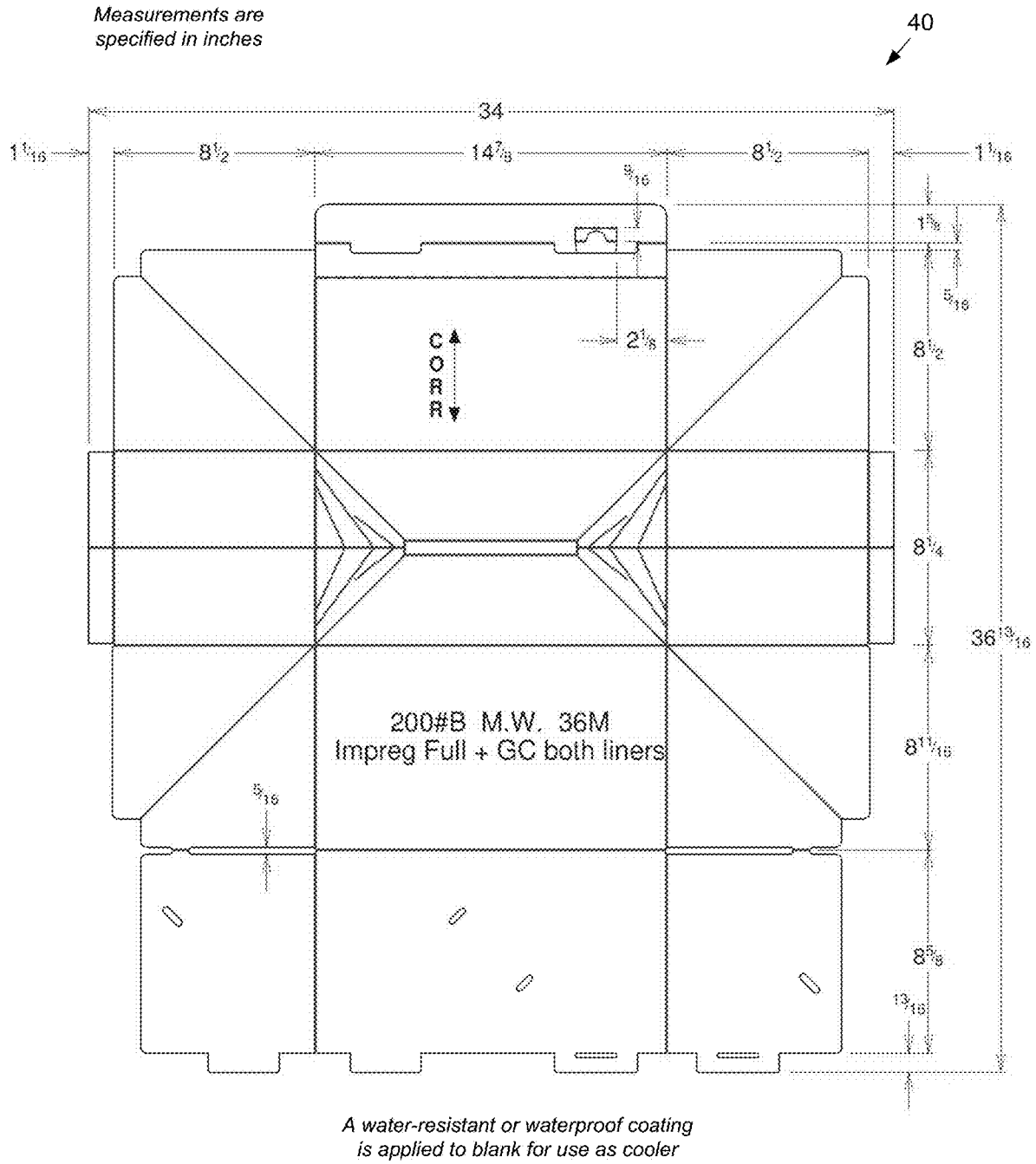
FIG. 2 is another plan view of the first side of the blank 40, wherein preferred dimensions of the blank 40 are shown; wherein fold lines are illustrated in red; and, wherein perforated lines each is illustrated in a dashed red line.
Figure 3:
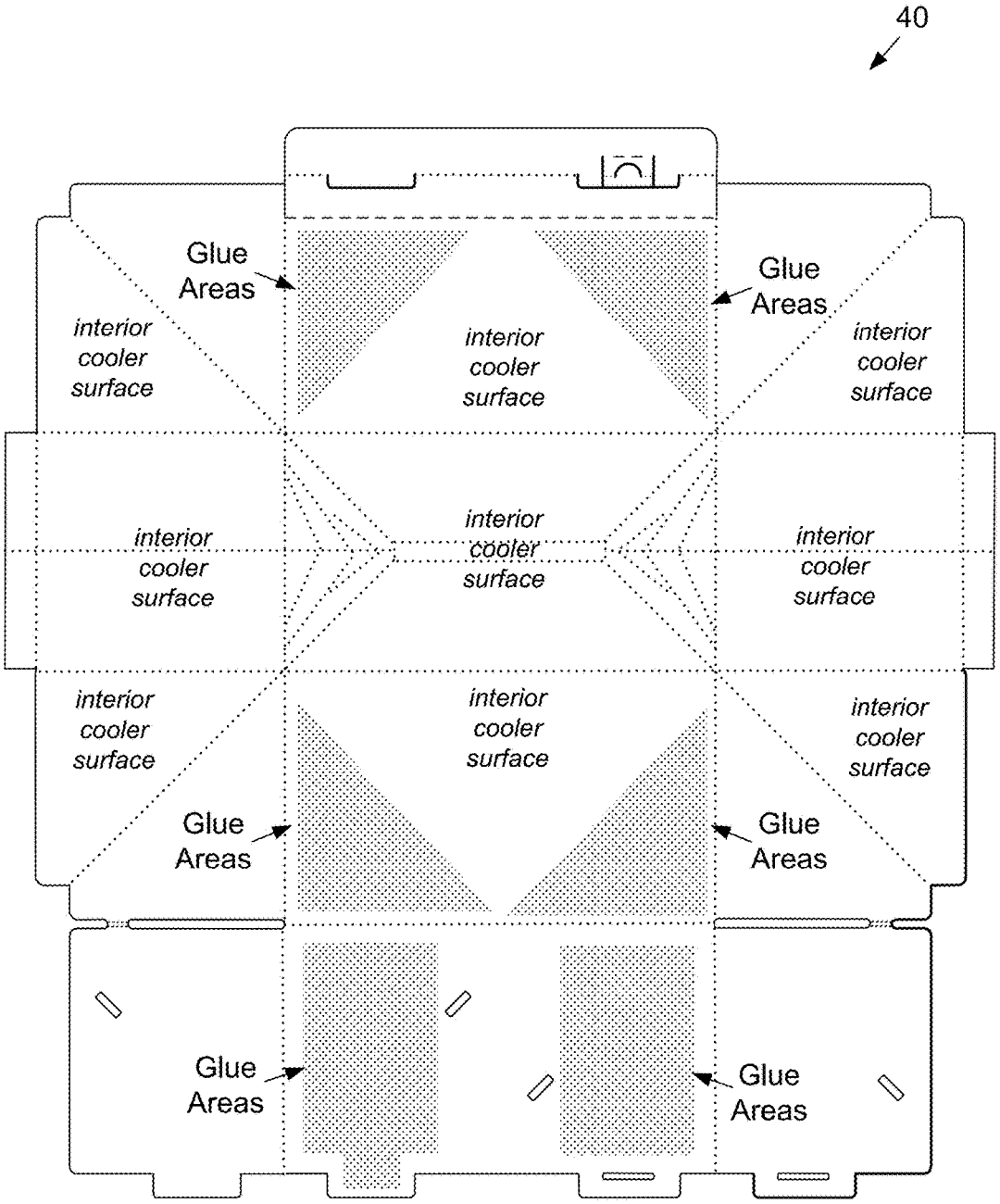
FIG. 3 is another plan view of the first side of the blank 40, wherein areas are highlighted to which areas glue is applied when the blank 40 is folded into a cooler configuration for holding the folded blank 40 in such cooler configuration.
Figure 4:
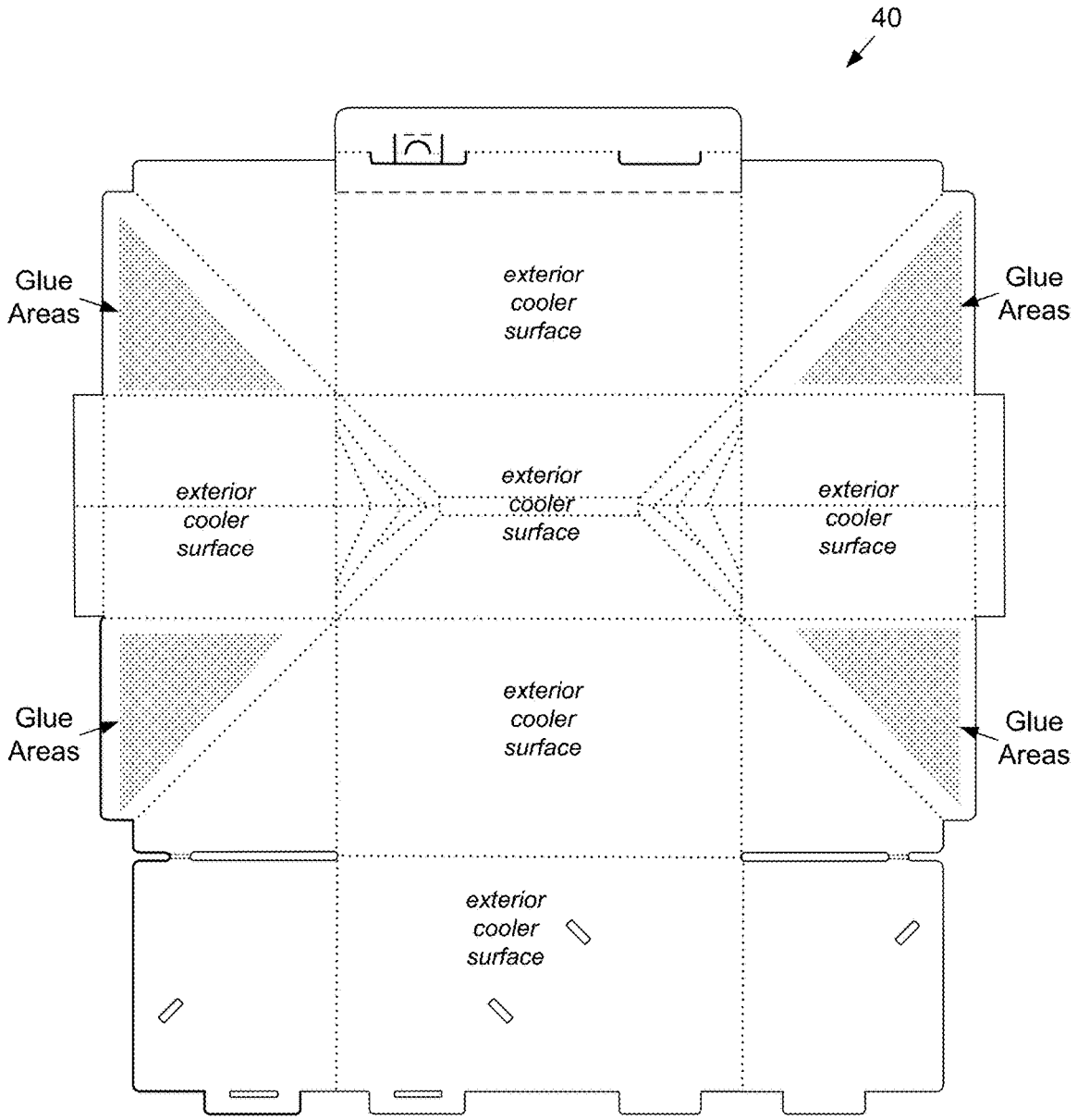
FIG. 4 is a plan view of a second, opposite side of the blank 40, wherein areas are highlighted to which areas glue is applied when the blank 40 is folded into the cooler configuration for holding the folded blank 40 in such cooler configuration.

Turning now to a discussion of a first preferred embodiment, FIG. 1 is a plan view of a first side of a blank 40 for forming a preferred cooler in accordance with one or more aspects and features of the invention. Additionally, FIG. 2 is another plan view of the first side of the blank 40, wherein preferred dimensions of the blank 40 are shown; wherein fold lines are illustrated in red; and wherein perforated lines each is illustrated in a dashed red line. FIG. 3 is another plan view of the first side of the blank 40, wherein areas are highlighted to which areas glue is applied when the blank 40 is folded into a cooler configuration for holding the folded blank 40 in such cooler configuration. FIG. 4 is a plan view of a second, opposite side of the blank 40, wherein areas are highlighted to which areas glue is applied when the blank 40 is folded into the cooler configuration for holding the folded blank 40 in such cooler configuration.

The blank 40 comprises fold lines that extend between and define panels and subpanels in the blank 40. In particular detail, a bottom panel comprises bottom subpanels 54,56 defined in part by fold lines 57,59 extending therebetween; a first end panel comprises end subpanels 62,64 defined in part by fold line 78 extending therebetween; and a second end panel comprises end subpanels 66,68 defined in part by fold line 86 extending therebetween. The bottom panel further comprises center subpanel 60 defined by fold lines forming an elongate, rectangular pattern 58. Fold line 50 extends between and further defines subpanels 54,62; fold line 52 extends between and further defines subpanels 56,64; fold line 44 extends between and further defines subpanels 54,66; and, fold line 46 extends between and further defines subpanels 56,68.

Fold line 42 extends between and divides subpanel 54 and a front panel 61; and fold line 48 extends between and divides subpanel 56 and rear panel 63.

The blank 40 comprise four corner panels including: a first corner panel comprising subpanels 65,67; a second corner panel comprising subpanels 69,71; a third corner panel comprising subpanels 73,75; and, a fourth corner panel comprising subpanels 77,79. A fold line 81 extends between and divides subpanels 65,67; a fold line 83 extends between and divides subpanels 69,71; a fold line 85 extends between and divides subpanels 73,75; and a fold line 87 extends between and divides subpanels 77,79.

Additionally, fold line 89 extends between and divides subpanel 67 and front panel 61; fold line 91 extends between and divides subpanel 69 and front panel 61; fold line 93 extends between and divides subpanel 75 and rear panel 63; and fold line 95 extends between and divides subpanel 77 and rear panel 63. Furthermore, fold line 74 extends between and divides subpanel 62 and subpanel 65; fold line 82 extends between and divides subpanel 66 and subpanel 71; fold line 84 extends between and divides subpanel 68 and subpanel 73; and fold line 76 extends between and divides subpanel 64 and subpanel 79.

The blank 40 comprises a lid comprising top panel 102 and reinforcing handle attachment panels 104,106. Fold line 101 extends between and divides rear panel 63 and top panel 102; fold line 103 extends between and divides reinforcing handle attachment panel 104 and top panel 102; and fold line 105 extends between and divides reinforcing handle attachment panel 106 and top panel 102. Additionally, a very short double fold line 107 extends between and divides subpanel 77 and reinforcing handle attachment panel 104; a very short double fold line 109 extends between and divides subpanel 75 and reinforcing handle attachment panel 106. Where double fold line 107 might otherwise be expected to extend between subpanel 77 and panel 104, an elongate opening 111 is provided on one side and an elongate recess 113 is provided on the other, and where double fold line 109 might otherwise be expected to extend between subpanel 75 and panel 106, an elongate opening 115 is provided on one side and an elongate recess 117 is provided on the other.

For receiving a handle, the top panel 102 includes slot openings 108,110 each configured to receiving a respective end of a handle therethrough. Reinforcing handle attachment panel 104 includes a corresponding slot opening 112 that aligns with slot opening 108 when reinforcing handle attachment panel 104 is folded about fold line 103 and is configured also to receive therethrough the respective end of the handle that is received through slot opening 108. Similarly, reinforcing handle attachment panel 106 includes a corresponding slot opening 114 that aligns with slot opening 110 when reinforcing handle attachment panel 106 is folded about fold line 105 and is configured also to receive therethrough the respective end of the handle that is received through slot opening 110. This two-apply attachment of a handle on opposite ends thereof is believed to reinforce the attachment of the handle.

The top panel 102 and reinforcing handle attachment panels 104,106 also include tabs 122,124,126,128. A locking slot opening 132 also is provided in top panel 102, with a corresponding locking slot opening 134 being provided in reinforcing handle attachment panel 106 that aligns with locking slot opening 132 when reinforcing handle attachment panel 106 is folded over onto top panel 102 about fold line 105.

In addition to the fold lines, the bottom panel also preferably comprises minor score lines on opposite ends of center subpanel 60. These minor score lines are indicated at 121 and at 123. These minor score lines are intended to facilitate collapsing of the cooler when in an assembled configuration after gluing and folding. Fold lines 57,59,78, 86,92,98 further facilitate the collapsing of the cooler.

The blank 40 also comprises end flanges that extend along the top of the ends of the cooler when the lid is open for access to the interior of the cooler. A first flange attached to the first end panel comprises flange subpanels 88,90; and a second flange attached to the second end panel comprises flange subpanels 94,96. A fold line 70 extends between and divides subpanels 62,88; a fold line 72 extends between and divides subpanels 64,90; a fold line 78 extends between and divides subpanels 66,94; and fold line 80 extends between and divides subpanels 68,96.

The blank 40 further comprises a latch panel comprising subpanels 152,154. A line of perforations 172 extends between and divides subpanel 152 and front panel 61. Fold lines 162,164,166 together with cuts 174,176 define a boundary that extends between and divides subpanels 152, 154. The blank 40 further comprises a latch 180 that is defined in subpanel 154. The latch 180 is attached to the remainder of the subpanel 154 along a very short line of perforations (as shown, the line comprises two perforations 182). The latch 180 further includes a semicircular cut 178 between adjacent fold lines 196,198 (seen in FIG. 9 of U.S. Patent Application Publication 2024/0228148 A1, which is incorporated herein by reference ("the '148 Publication")) for defining an ear 190 for gripping between a finger and thumb, which ear facilitates manual manipulation of the latch 180. In particular, the portion of the latch 180 that is integral with the ear 190 is configured to extend through the locking slot openings 132,134 when aligned and when the latch panel secures the lid in a closed position of the cooler. It will be appreciated that when in this position, tabs 122,124 (which align with each other) extend through cut 174, and tabs 126,128 (which also align with each other) extend through cut 176 of the latch panel.

Figure 7:
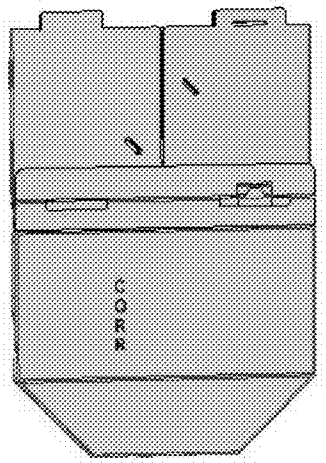
FIGS. 5, 6, and 7 illustrate perspective views of the folding of a blank into an assembled cooler in a collapsed configuration (and wherein the handle has not yet been attached).
Figure 5:
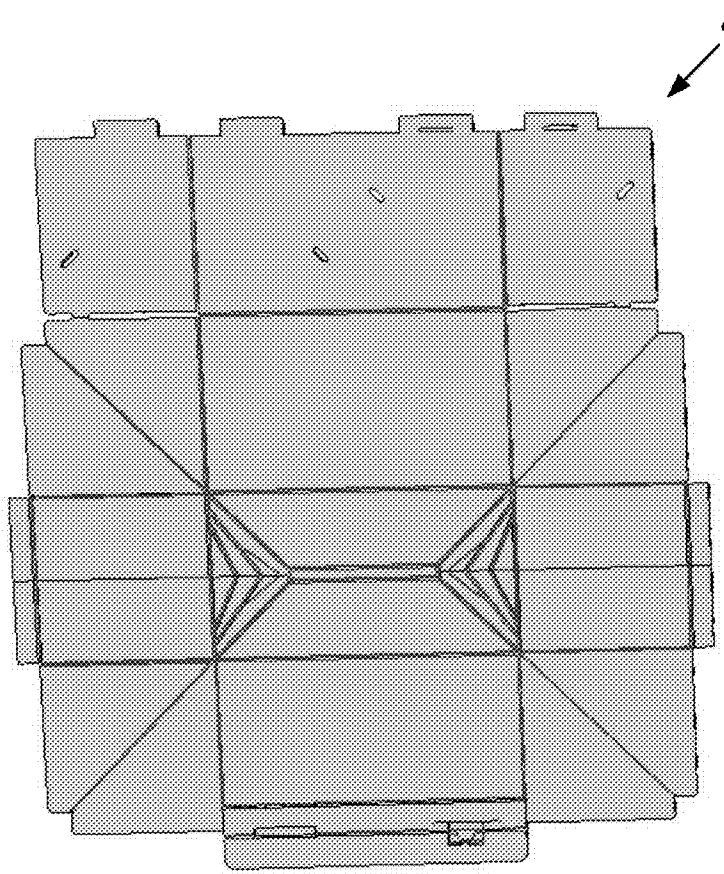
Figure 11:
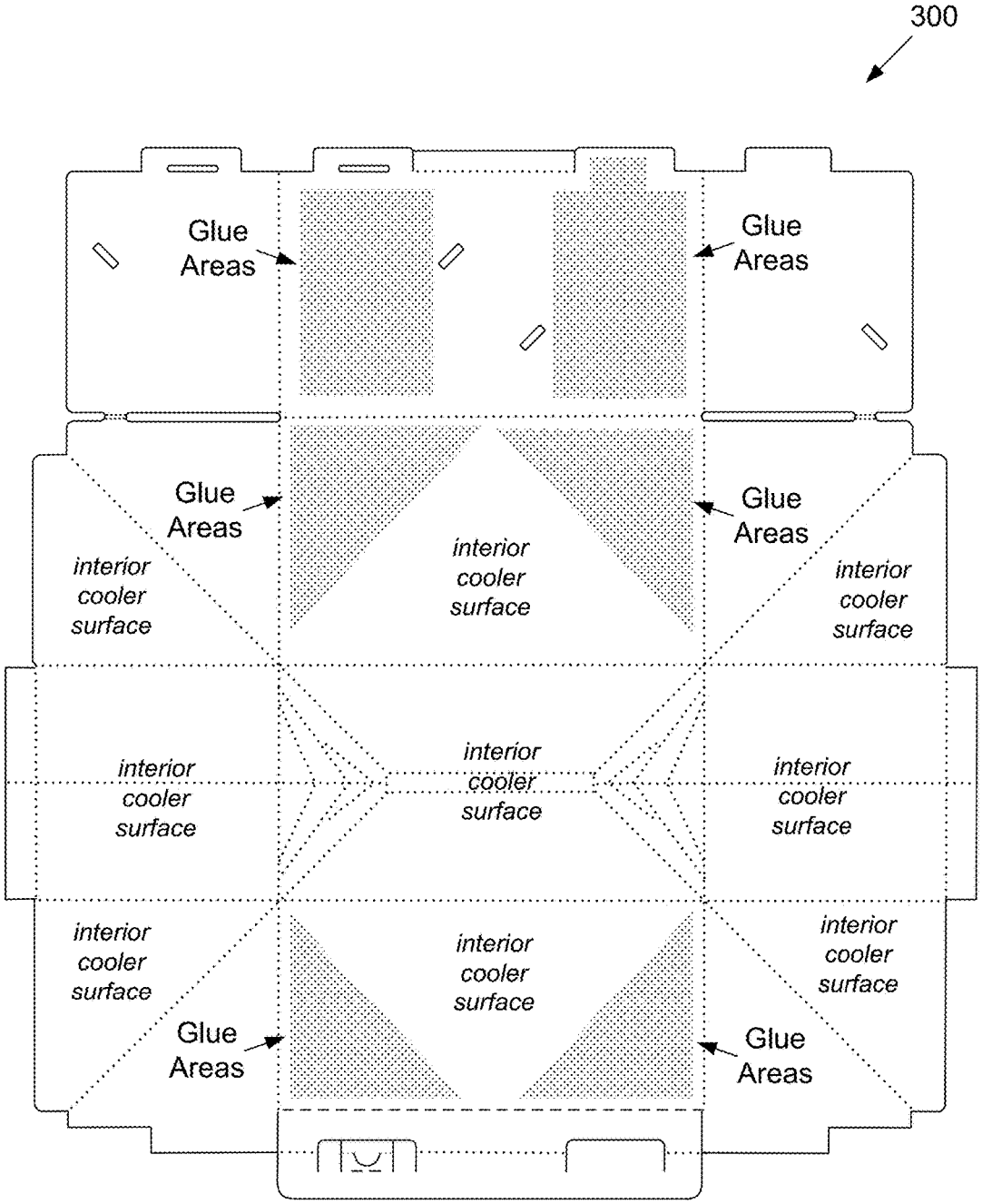
FIG. 11 is a plan view of a first side of another blank for forming a preferred cooler in accordance with one or more aspects and features of the invention, wherein areas are highlighted to which areas glue is applied when the blank is folded into a collapsed cooler configuration.
Figure 12:
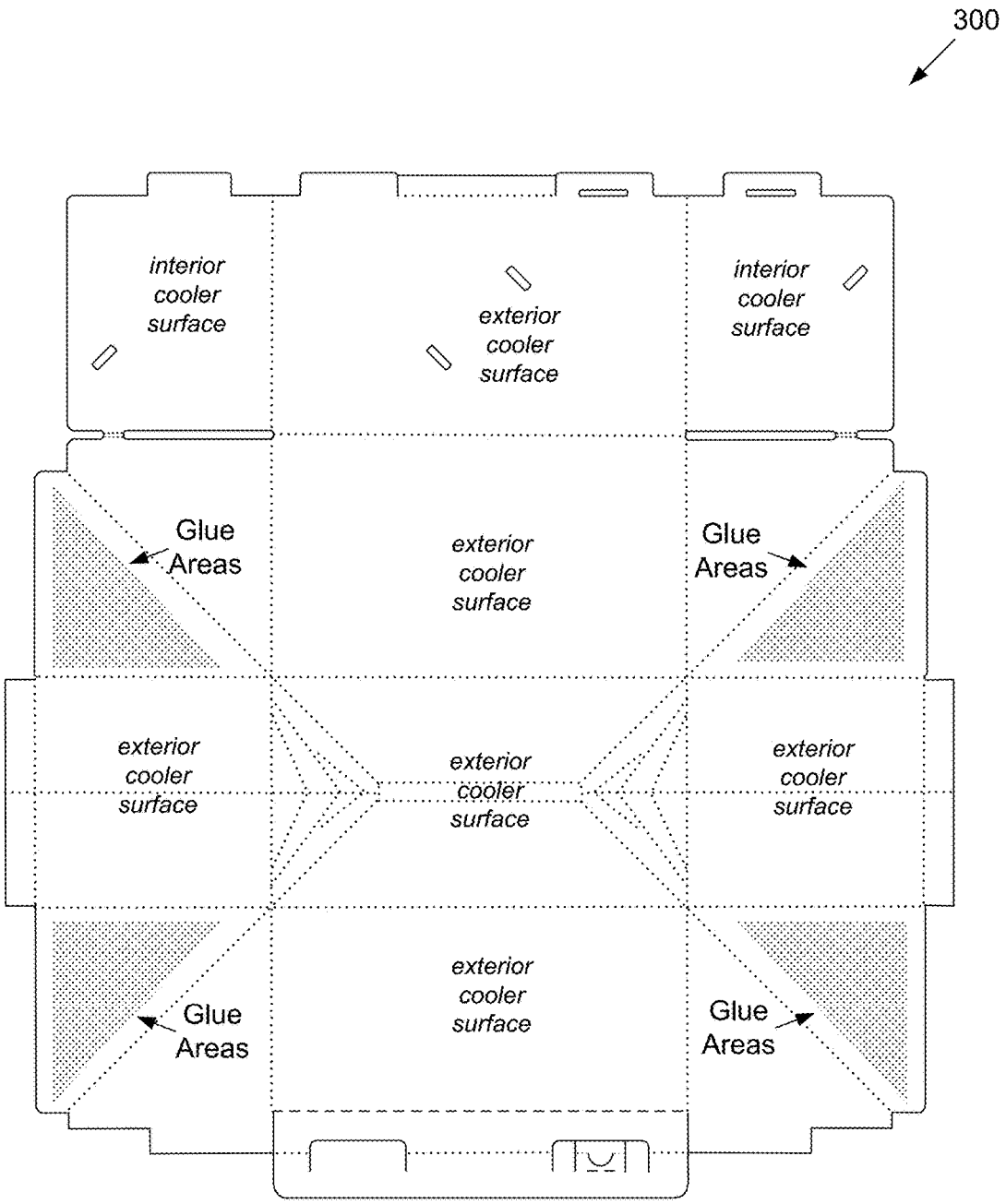
FIG. 12 is a plan view of a second, opposite side of the blank of FIG. 11 wherein areas are highlighted to which areas glue is applied when the blank is folded into the collapsed cooler configuration.
Figure 13:
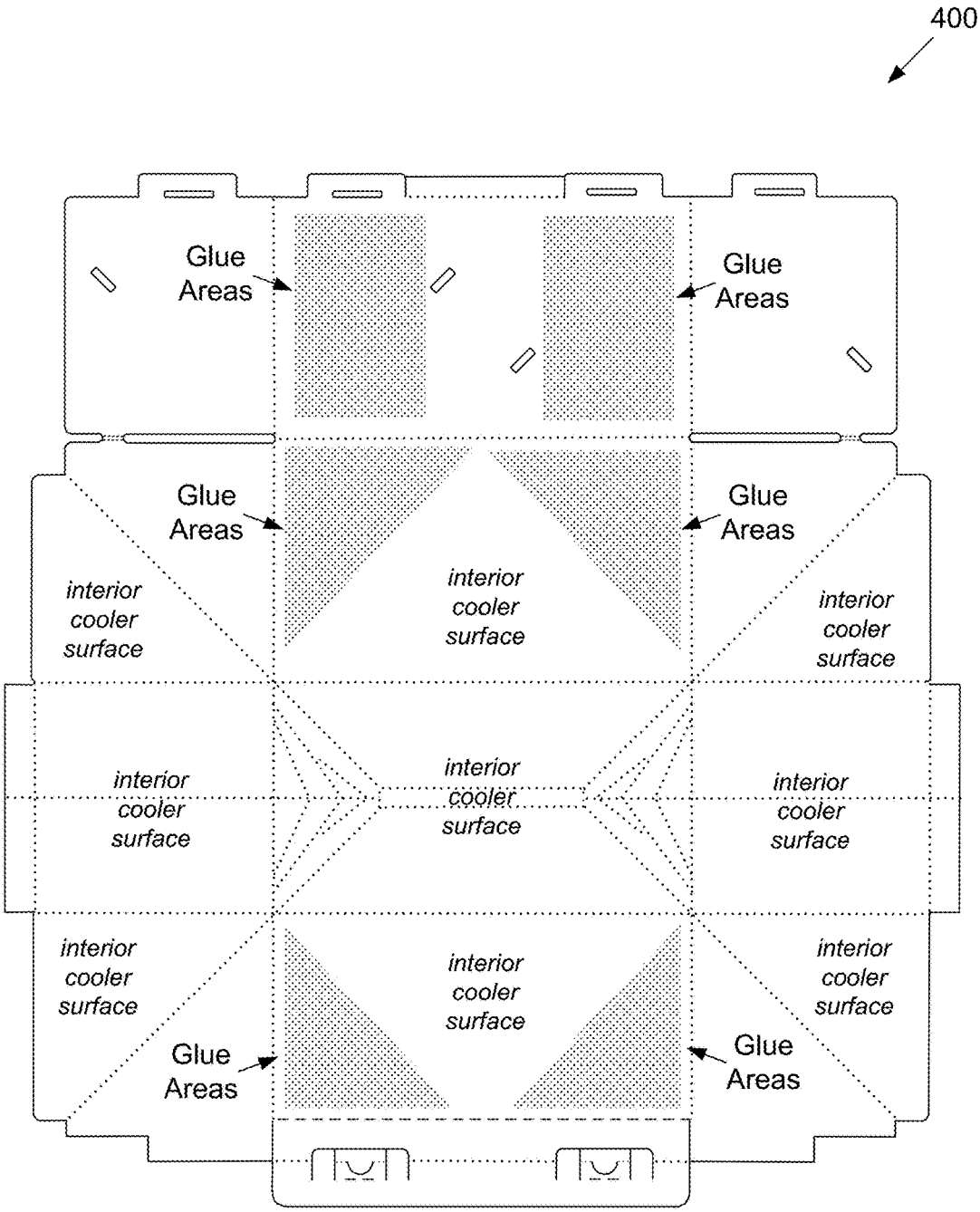
FIG. 13 is a plan view of a first side of another blank for forming a preferred cooler in accordance with one or more aspects and features of the invention, wherein areas are highlighted to which areas glue is applied when the blank is folded into a collapsed cooler configuration.
Figure 14:
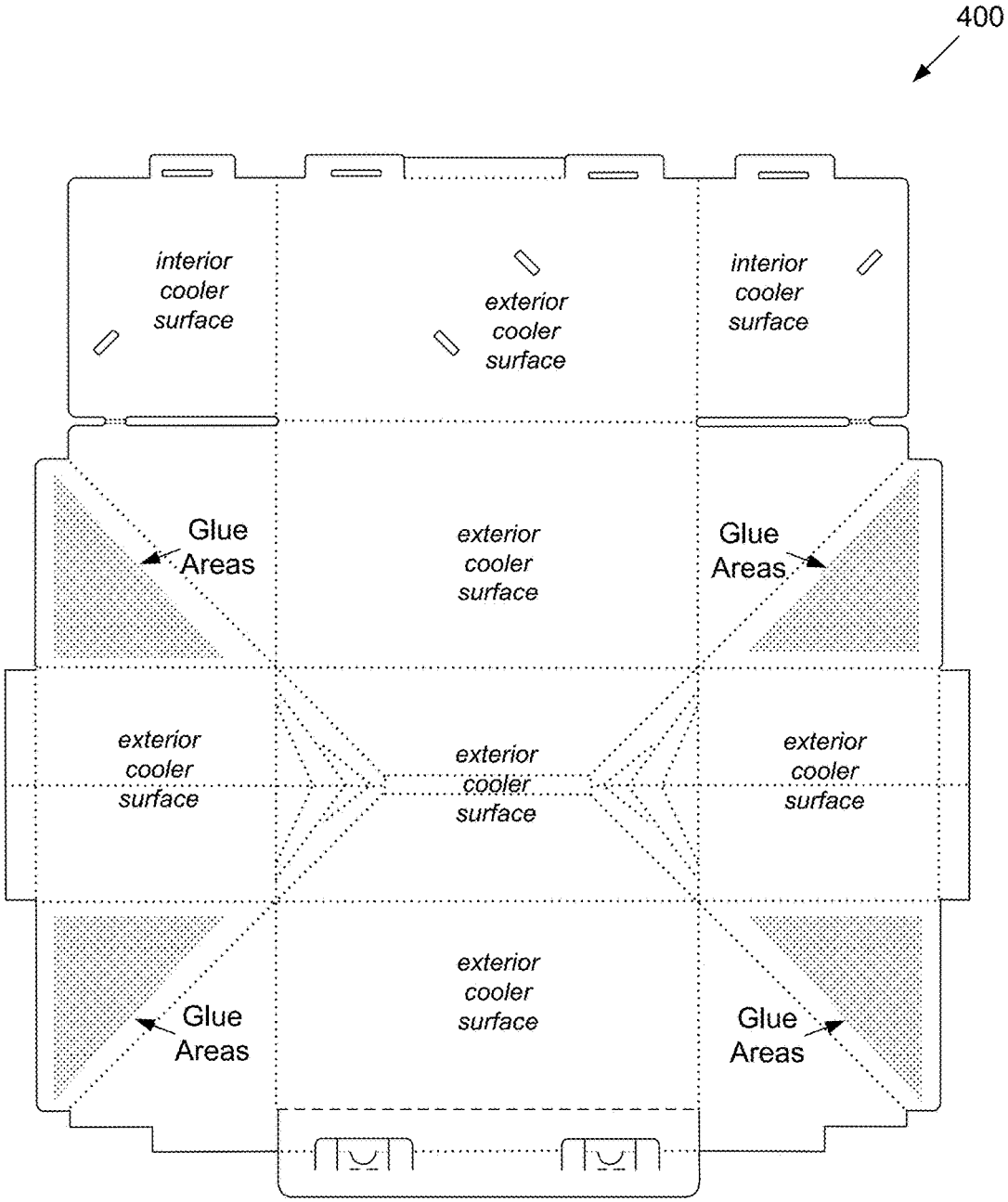
FIG. 14 is a plan view of a second, opposite side of the blank of FIG. 13 wherein areas are highlighted to which areas glue is applied when the blank is folded into the collapsed cooler configuration.
Figure 15:
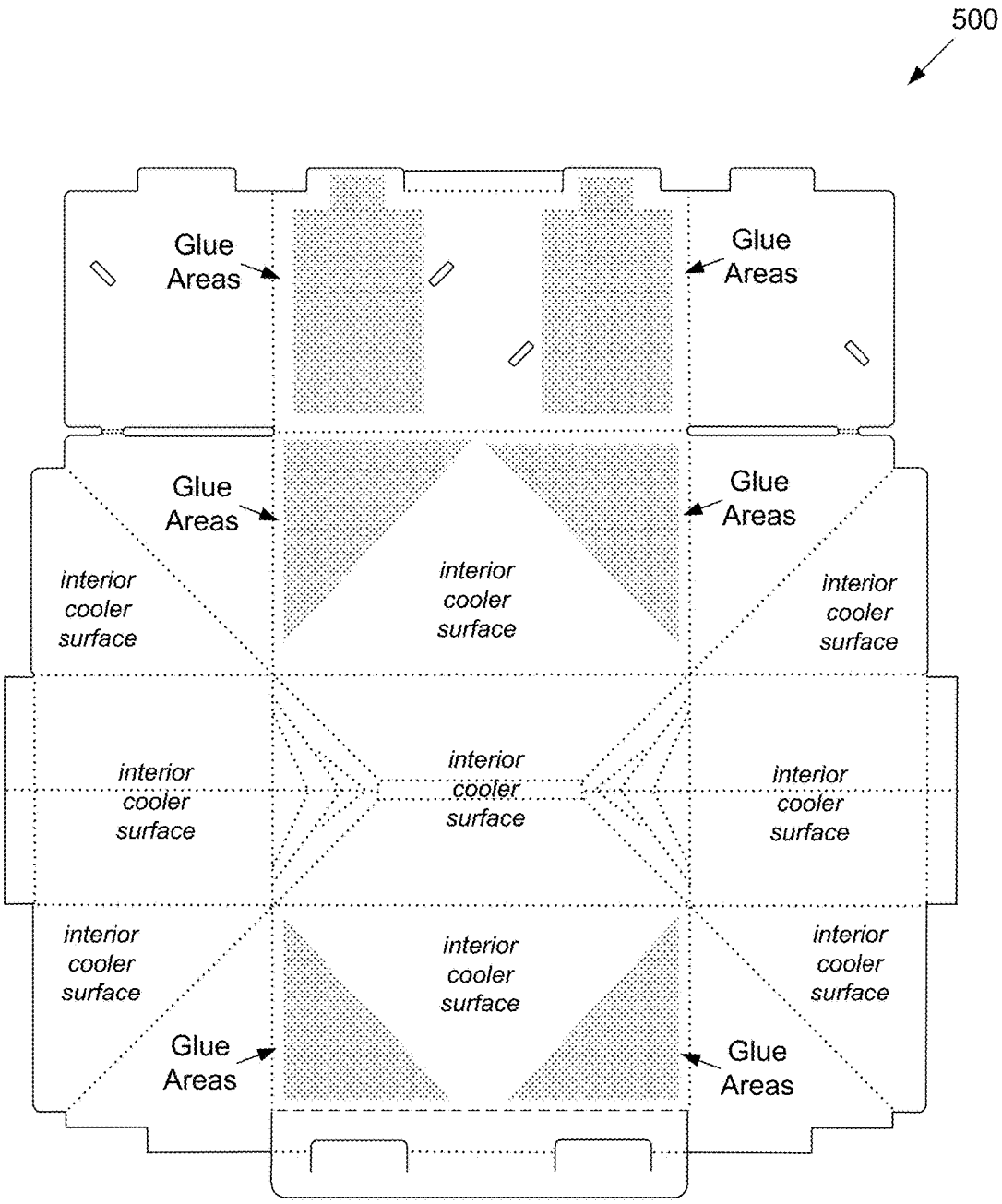
FIG. 15 is a plan view of a first side of another blank for forming a preferred cooler in accordance with one or more aspects and features of the invention, wherein areas are highlighted to which areas glue is applied when the blank is folded into a collapsed cooler configuration.
Figure 16:
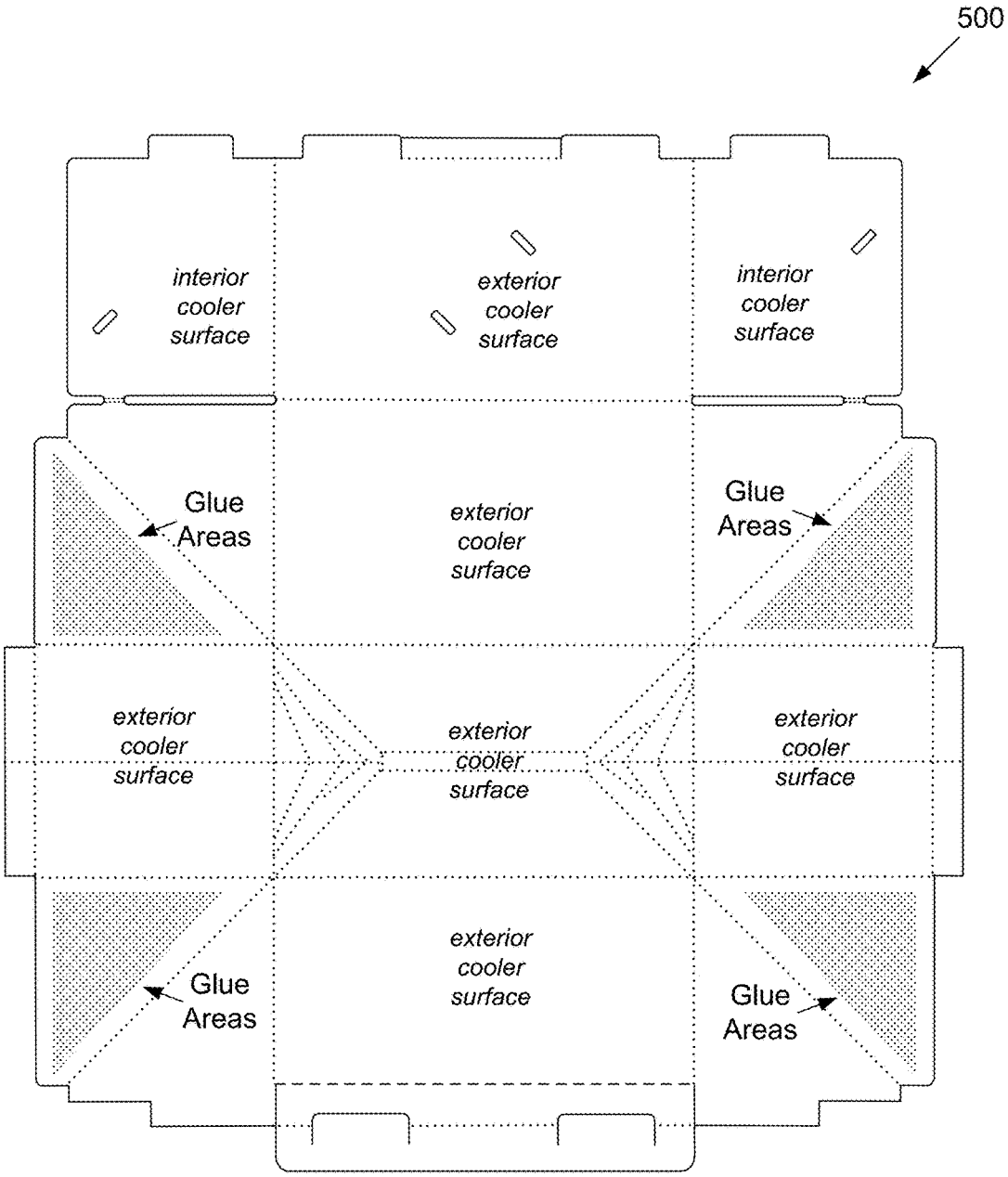
FIG. 16 is a plan view of a second, opposite side of the blank of FIG. 15 wherein areas are highlighted to which areas glue is applied when the blank is folded into the collapsed cooler configuration.

FIG. 5 of the '148 Publication is a perspective view of a top of a cooler 200 that has been formed from the blank 40 by gluing and folding of the blank 40 and attachment of a handle 202. The handle includes opposite ends. Each end is inserted through a pair of corresponding openings in the top panel and one of the reinforcing handle attachment panels. Additionally, FIG. 6 of the '148 Publication is a perspective view of a front side of the cooler 200; FIG. 7 of the '148 Publication is a perspective view of a top of the latching mechanism 180 of the cooler 200; FIG. 8 of the '148 Publication is another perspective view of the top of the latching mechanism 180; FIG. 9 of the '148 Publication is another perspective view of the top of the latching mechanism 180; FIG. 10 of the '148 Publication is a perspective view of the top of the cooler 200 with the lid in an open position for access to the interior of the cooler 200; FIG. 11 of the '148 Publication is another perspective view of the top of the cooler 200 with the lid in the open position; FIG. 12 of the '148 Publication is another perspective view of the top of the cooler 200 with the lid in the open position; FIG. 13 of the '148 Publication is a perspective view of a front wall of the inside of the cooler 200; FIG. 14 of the '148 Publication is a perspective view of a front of the cooler 200; FIG. 15 of the '148 Publication is a perspective view of an end of the cooler 200; FIG. 16 of the '148 Publication is another perspective view of the end of the cooler 200; FIG. 17 of the '148 Publication is a perspective view of a front of the assembled cooler 200 when in a collapsed configuration; FIG. 18 of the '148 Publication is a perspective view of a back of the assembled cooler 200 when in the collapsed configuration; FIG. 19 of the '148 Publication is a perspective view of an end of the assembled cooler 200 when in the collapsed configuration; and FIG. 20 of the '148 Publication is a perspective view of another, opposite end of the assembled cooler 200 when in the collapsed configuration.

With reference, for example, to FIG. 12 of the '148 Publication, it will be appreciated that the portions of the blank 40 along which the very short double fold lines 107,109 extend are torn or ripped such that the panels are no longer attached or otherwise connected to any corner panel after folding of the blank 40. Preferably, this is done when the blank 40 is being folded into the assembled, collapsed configuration using a machine. This preferably is accomplished by making these portions sufficiently short that folding motion still is transmitted via these portions between the panels and subpanels 104,77 and 106,75 but that following such folding motion these portions rip or tear when the top panel is pivoted relative to the front panel 63. Otherwise, any connection between the panels and subpanels 104,77 and 106,75 will inhibit to some minor extent the movement of the lid between open and closed positions; disconnecting the panels and subpanels 104,77 and 106,75 therefore will facilitate the complete opening and closing of the lid.

FIGS. 5-3 illustrate perspective views of the folding of the blank 40 into the assembled cooler 200 in a collapsed configuration (the handle has not yet been attached).

Figure 6:
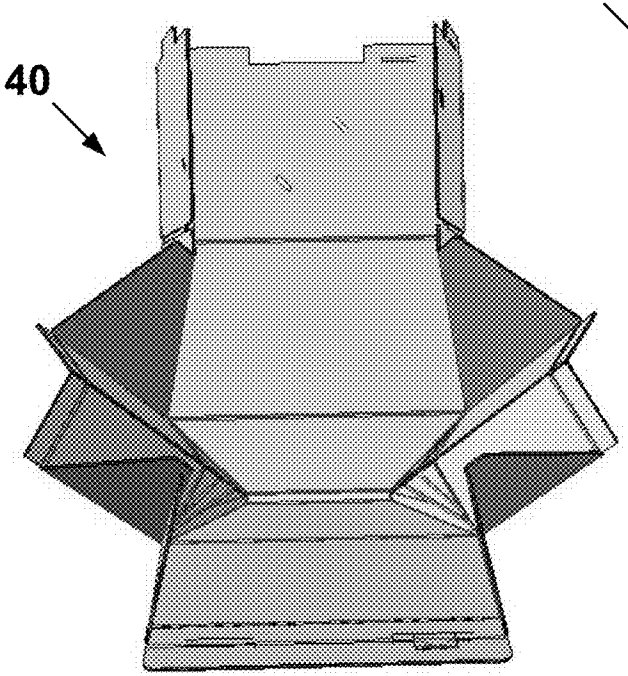

FIGS. 8-16 illustrate additional perspective views corresponding, respectively, to FIGS. 5-7 showing the folding of the blank 40 into the cooler 200 in the assembled, collapsed cooler configuration.

FIG. 11 is a plan view of a first side of another blank 300 for forming a preferred cooler in accordance with one or more aspects and features of the invention, wherein areas are highlighted to which areas glue is applied when the blank is folded into a collapsed cooler configuration. Furthermore, FIG. 12 is a plan view of a second, opposite side of the blank 300, wherein areas are highlighted to which areas glue is applied when the blank is folded into the collapsed cooler configuration.

FIG. 13 is a plan view of a first side of another blank 400 for forming a preferred cooler in accordance with one or more aspects and features of the invention, wherein areas are highlighted to which areas glue is applied when the blank is folded into a collapsed cooler configuration. Furthermore, FIG. 14 is a plan view of a second, opposite side of the blank 400 wherein areas are highlighted to which areas glue is applied when the blank is folded into the collapsed cooler configuration.

FIG. 15 is a plan view of a first side of another blank 500 for forming a preferred cooler in accordance with one or more aspects and features of the invention, wherein areas are highlighted to which areas glue is applied when the blank is folded into a collapsed cooler configuration. Furthermore, FIG. 16 is a plan view of a second, opposite side of the blank 500, wherein areas are highlighted to which areas glue is applied when the blank is folded into the collapsed cooler configuration.

FIG. 17 of the '148 Publication is a perspective view of a portion of the interior side of a lid of a cooler 600 formed from a blank similar to that of FIGS. 15-16 of the '148 Publication, wherein the top panel of the cooler 600 includes an insert 608 located between the tabs.

FIG. 18 of the '148 Publicati34 is a perspective view of a recess 610 that is formed in a front wall of the cooler 600, which recess 610 is configured to receive the insert 608 of the cooler 600, which reinforces securement of the lid and latching panel when the lid is closed.

FIG. 19 of the '148 Publicati35 is a perspective view of a portion of the interior ide of another lid of a cooler 700 formed in accordance with one or more aspects and features of the invention, wherein the tabs have a profile different from that of the tabs seen in FIG. 17 of the '148 Puication33. Each tab includes a recess 710 for further engagement of the latching panel when the lid is closed.

Based on the foregoing description, it will be readily understood by those persons skilled in the art that the present invention has broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A box made by folding a sheet of material, comprising:
(a) a storage portion, including:
(i) a bottom panel,
(ii) a first end panel,
(iii) a second end panel,
(iv) a first side panel, and
(v) a second side panel;
(b) four corner panels;
(c) a top panel including one or more tabs; and
(d) a latching panel attached to the first side panel and pivotable relative thereto about a fold line, the latching panel comprising first and second subpanels, wherein the latching panel includes cuts extending between and dividing the first and second subpanels through which the one or more tabs extend when the box is in a closed position.

2. The box of claim 1, wherein a line of perforations extends between and divides the latching panel and the first side panel.

3. The box of claim 1, further comprising a latch for securing together the latching panel and the lid when the box is in the closed position, one of the one or more tabs including a slot through which a portion of the latch is configured to extend.

4. The box of claim 3, further comprising a second latch for securing together the latching panel and the lid when the box is in the closed position, another one of the one or more tabs including a slot through which a portion of the second latch is configured to extend.

5. The box of claim 1, further comprising first and second reinforcing handle attachment panels.

6. The box of claim 1, wherein a waterproof or water resistant coating is applied to the sheet of material of the box for use of the box as a cooler.

7. The box of claim 6, wherein a fold line extends between and divides the first reinforcing handle attachment panel and the top panel, and wherein no fold line extends between and divides the first reinforcing handle attachment panel and any of the four corner panels, the first reinforcing handle attachment panel being separated from each of the four corner panels; and wherein a fold line extends between and divides the second reinforcing handle attachment panel and the top panel, and wherein no fold line extends between and divides the second reinforcing handle attachment panel and any of the four corner panels, the second reinforcing handle attachment panel being separated from each of the four corner panels.

8. The box of claim 1, wherein the box is in an assembled, collapsed configuration.

9. The box of claim 1, wherein the box comprises a folded and adhered one-piece blank.

10. A box made by folding a sheet of material, comprising:
(a) a storage portion, including:
(i) a bottom panel comprising first and second bottom subpanels,
(ii) a first end panel comprising first and second end subpanels,
(iii) a second end panel comprising first and second end subpanels,
(iv) a first side panel, and
(v) a second side panel;
(b) four corner panels, including:
(i) a first corner panel comprising first and second corner panels,
(ii) a second corner panel comprising first and second corner panels,
(iii) a third corner panel comprising first and second corner panels, and
(iv) a fourth corner panel comprising first and second corner panels;
(c) a top panel including a plurality of tabs;
(d) a first reinforcing handle attachment panel including a tab;
(e) a second reinforcing handle attachment panel including a tab; and
(f) a latching panel comprising first and second subpanels, wherein the latching panel includes cuts extending between and dividing the first and second subpanels through which extend said tabs of the top panel and first and second reinforcing handle attachment panels when the cooler is in a closed position.

11. The box of claim 10, further comprising a latch for securing together the latching panel and the lid when the cooler is in the closed position.

* * * * *